US006682340B2

(12) United States Patent
Kim

(10) Patent No.: US 6,682,340 B2
(45) Date of Patent: Jan. 27, 2004

(54) LIGHTER SAFETY MECHANISM

(76) Inventor: Jin Ki Kim, c/o Bultina America Corp., 2133 Serrano Pl., Fullerton, CA (US) 92833

( * ) Notice: Subject to any disclaimer, the term of this patent is extended or adjusted under 35 U.S.C. 154(b) by 0 days.

(21) Appl. No.: 10/153,843

(22) Filed: May 21, 2002

(65) Prior Publication Data

US 2003/0219687 A1 Nov. 27, 2003

(51) Int. Cl.[7] ..... F23Q 2/28
(52) U.S. Cl. ..... 431/153; 431/255
(58) Field of Search ..... 431/153, 255; F23Q 2/28, 3/00, 3/01; H02N 2/18

(56) References Cited

U.S. PATENT DOCUMENTS 4,832,596 A * 5/1989 Morris, Sr. ..... 431/153
5,655,901 A * 8/1997 Makoto ..... 431/153
5,662,466 A * 9/1997 Cheng ..... 431/153
5,697,775 A * 12/1997 Saito et al. ..... 431/153
6,042,367 A * 3/2000 Saito et al. ..... 431/153
6,093,017 A * 7/2000 Saito et al. ..... 431/153
6,106,277 A * 8/2000 Xie ..... 431/153
6,135,762 A 10/2000 Hu ..... 431/153
6,244,858 B1 * 6/2001 Wang ..... 431/153

FOREIGN PATENT DOCUMENTS

GB 2324140 A * 10/1998 ..... F23Q/2/16

* cited by examiner

*Primary Examiner*—Ira S. Lazarus
*Assistant Examiner*—James G. Barrow
(74) *Attorney, Agent, or Firm*—Ostrolenk, Faber, Gerb & Soffen, LLP

(57) ABSTRACT

A lighter that includes a safety mechanism for preventing its ignition. A piezoelectric lighter ignition unit has a plunger that is movable into a main casting to generate sparks for igniting a stream of flammable gas. A safety mechanism includes a plunger which includes a notch at one side to define an open surface that extends transversely to the direction of motion of the plunger. A latch has a stop portion that makes contact with the transverse open surface to obstruct the motion of the plunger. An arm moves the latch.

17 Claims, 3 Drawing Sheets

LIGHTER SAFETY MECHANISM

BACKGROUND OF THE INVENTION

The present invention relates to a safety mechanism for a lighter, and more specifically a safety mechanism that obstructs the operation of the piezoelectric unit in the lighter to prevent ignition of fuel.

Some types of lighters typically include a piezoelectric unit, which when operated, produces sparks to ignite a stream of flammable gas. A conventional piezoelectric unit includes a plunger which is moveable within a main casting. The main casting includes an electrical ceramic element. When the plunger is pressed into the main casting, its bottom portion strikes the electrical ceramic element to generate an electric current. In a typical lighter, flammable gas is supplied from a chamber to a nozzle. The electric current produced by the piezoelectric unit is delivered to a position near the nozzle where it is emitted as a spark to ignite the gas that is streaming out of the nozzle.

The use of conventional lighters is relatively simple. In conventional lighters, for example, the plunger of the piezoelectric unit is connected to a trigger, a button, or some other actuating mechanism that can be manipulated by a user to press the plunger into the main casting of the piezoelectric unit. The simplicity of operation of conventional lighters is disadvantageous as it makes it easy for children to ignite the lighter thereby creating a risk of accidental fires. To reduce the risk of misuse by children, mechanisms have been incorporated in lighters to make their use more complicated. Often such mechanisms include a safety feature which must first be actuated before the lighter is ready to be used. A well known mechanism for preventing usage of a lighter by children involves a mechanism for obstructing the motion of the trigger to prevent ignition of the lighter. U.S. Pat. No. 6,135,762, for example, shows a lighter which includes a feature that engages the trigger to obstruct its motion. Such mechanisms work well. Generally, however, such safety mechanisms include a trigger mechanism having unique features. Thus, to take advantage of such safety mechanisms, the trigger mechanism of the lighter must be designed according to such unique features. That means that each commercial lighter must be customized to include the unique features. It is desirable to provide a safety mechanism that can be universally incorporated into all commercial lighters utilizing a piezoelectric unit, without regard to the configuration of the trigger itself.

SUMMARY OF THE INVENTION

It is an object of the present invention to provide a lighter safety mechanism that might be incorporated in any lighter which includes a piezoelectric ignition unit.

A lighter regardless of the purpose for which the lighter may be used and regardless of its shape and size, according to the present invention includes a universal safety mechanism for a piezoelectric lighter ignition unit. That mechanism has an ignition plunger that is selectively moveable within a main casting to generate a spark for igniting a stream of flammable gas, and some type of locking object or stop obstructs the movement of the plunger into the main casting to prevent ignition. Examples of stops may be any element that presents an obstacle, such as a rod, a spring, a latch etc.

In one preferred non-limiting embodiment, the plunger of the piezoelectric unit according to the present invention includes a notch on one side thereof. The notch has an open surface which is oriented transverse to the direction of motion of the plunger. The latch includes a stop portion which is selectively moveable to a position where it may oppose the transverse open surface in order to obstruct the motion of the plunger.

In a lighter safety mechanism according to the preferred embodiment, the latch includes an arm which is integral with the stop portion to form a unitary L-shaped latch. The arm portion extends from the interior of the housing of the lighter that houses the piezoelectric unit to the exterior of the housing where it may be manipulated by a user to selectively move the stop portion from a stop position where it opposes the transverse open surface to an open position away from the transverse open surface to allow the plunger to be pressed freely into the main casting. According to the preferred embodiment, the latch is spring-loaded so that it is returned to a position where its stop portion may oppose the transverse open surface when the user stops manipulating the arm. Alternative types of stops or obstacle elements share in common the movability between the stop and open plunger motion positions.

Other features and advantages of the present invention will become apparent from the following description of the invention which refers to the accompanying drawings.

DETAILED DESCRIPTION OF THE PREFERRED EMBODIMENT

Figure 1A:
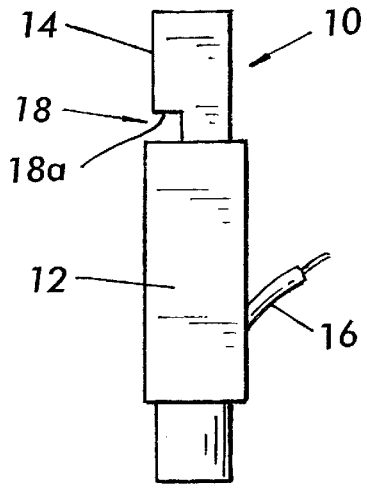
FIG. 1A shows a side elevation view of a piezoelectric unit according to an embodiment of the present invention.
Figure 1B:
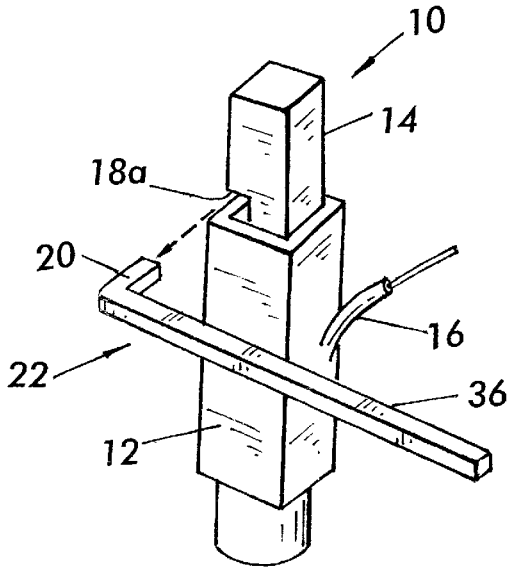
FIG. 1B shows a partially exploded perspective view of a lighter safety mechanism according to the present invention which includes the piezoelectric unit of FIG. 1A, and a latch that engages the plunger of the piezoelectric unit to prevent the piezoelectric unit from operating.

FIG. 1A shows a side view of a piezoelectric lighter ignition unit 10 that is used in a lighter according to the present invention. Piezoelectric unit 10 includes a main casting 12 and a plunger 14. Main casting 12 includes an opening which receives an end of plunger 14 and allows the same to be selectively moved inside main casting 12. As is conventionally known, piezoelectric unit 10 generates electricity and transmits the same to wire 16 when plunger 14 is pressed and thus caused to move inside main casting 12. The generated electricity is used to produce a spark to light a stream of flammable gas. Unless urged by an external force, most of the body of plunger 14 extends outside of main casting 12. Plunger 14 is spring loaded, however, by a spring inside casting 12 so that when the external force that urges plunger 14 into the main casting 12 ceases, plunger 14 returns to its original extended position.

Figure 1C:
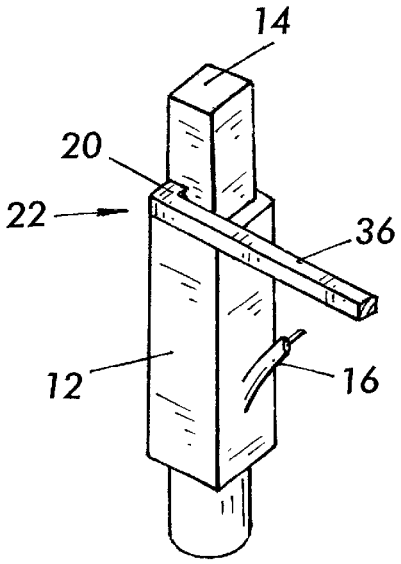
FIG. 1C shows a perspective view in which the latch shown in FIG. 1B engages the plunger of the piezoelectric unit to prevent the piezoelectric unit from operating.
Figure 1D:
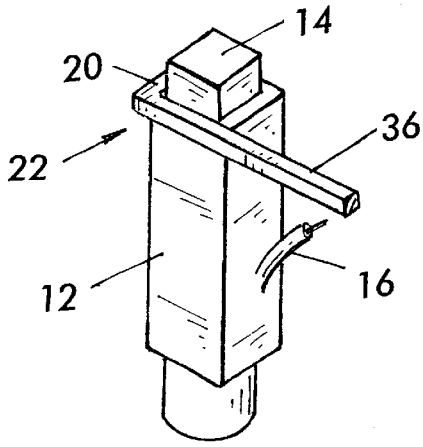
FIG. 1D shows a perspective view in which the latch shown in FIG. 1C has disengaged from the plunger of the piezoelectric unit to allow the piezoelectric unit to operate.

Referring now to FIGS. 1A–1D, plunger 14 includes a notch 18 on a side thereof. Notch 18 includes open surface 18*a* which is transverse to the direction of movement of plunger 14 into main casting 12. Notch 18 is large enough to receive stop portion 20 of latch 22. Referring specifically to FIG. 1C, once stop portion 20 of latch 22 is received in notch 18, transverse open surface 18*a* is opposed by stop portion 20 when plunger 14 is pressed in an inward direction into main casting 12. The contact between transverse open surface 18*a* and stop portion 20 obstructs the movement of plunger 14, thereby preventing the production of a spark that lights the flammable gas. As shown in FIG. 1D, once stop portion 20 is moved away from transverse open surface 18*a*, plunger 14 is free to move inwardly into main casting 12 to produce a spark to light the flammable gas.

Figure 2A:
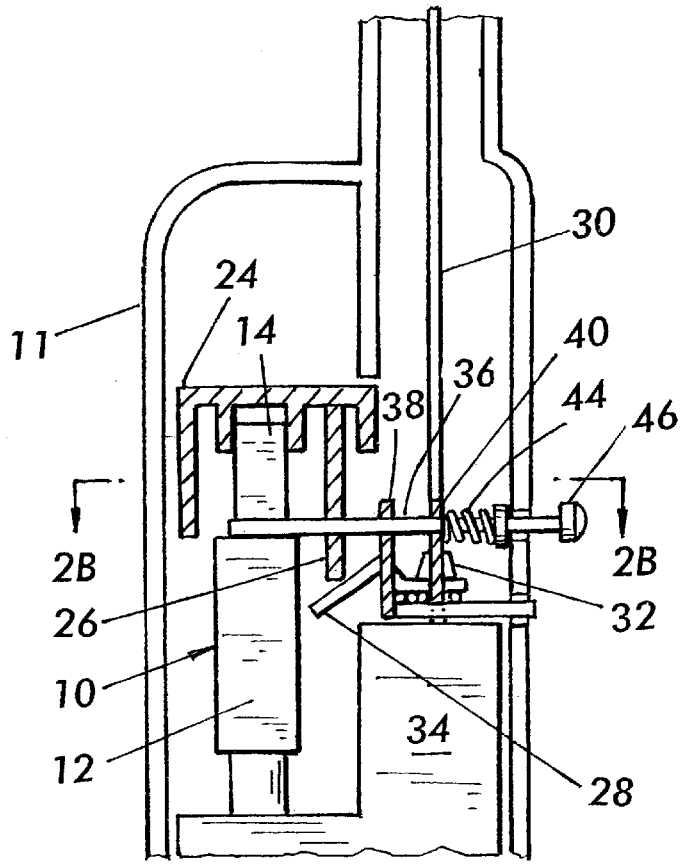
FIG. 2A shows schematically a side view of the interior of a lighter having a lighter safety mechanism that is engaged according to the present invention.

Piezoelectric unit 10 as incorporated in a lighter is shown in FIGS. 2A–2D. Referring to FIG. 2A, piezoelectric unit 10 is disposed in the interior of a housing 11. The free end of plunger 14 extends into a trigger 24. Trigger 24 is attached to the free end of plunger 14 to allow a user to press plunger 14 inwardly into main casting 12. Trigger 24 includes fuel release member 26 which extends in the direction of movement of plunger 14. As trigger 24 is pressed to press plunger 14 inwardly into casting 12 to produce a spark, the free end of member 26 contacts lever 28. This contact causes lever 28 to be moved in the direction of plunger 14. The movement of lever 28 causes a valve (not shown) to be opened to allow flammable gas to enter fuel tube 30 through nozzle 32 from fuel chamber 34. As plunger 14 is further pressed into main casting 12, a spark is produced to light the flammable gas.

Figure 2B:
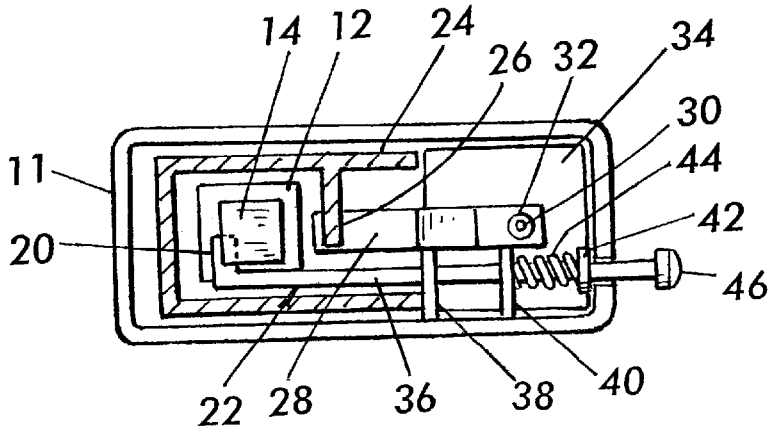
FIG. 2B is a cross-sectional view of the lighter shown in FIG. 2B along line 2B—2B in FIG. 2A looking in the direction of the arrows.
Figure 2C:
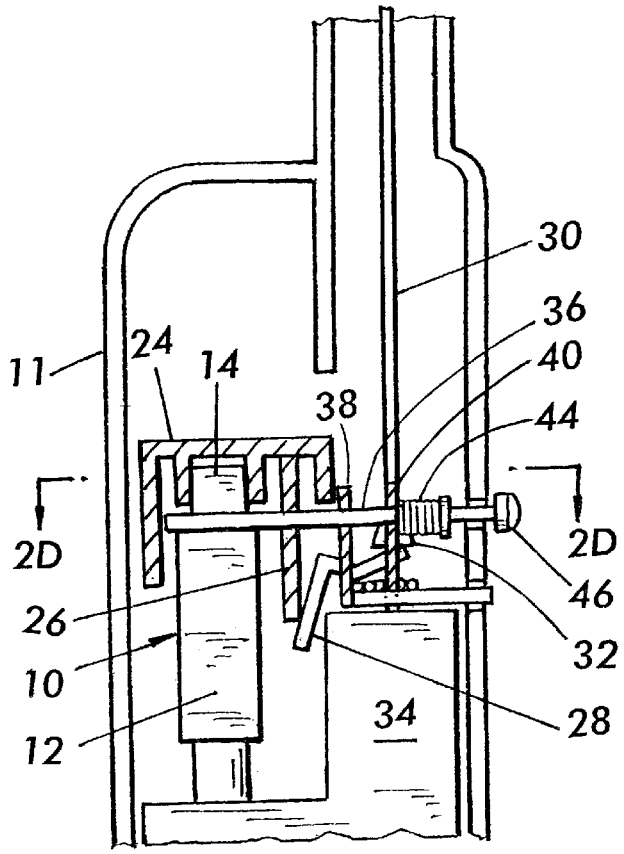
FIG. 2C shows schematically a side view of the interior of a lighter having a lighter safety mechanism according to the present invention in a disengaged condition.

Referring now to FIG. 2B, latch 22 includes arm 36 which is integral with stop portion 20 and extends from the interior of housing 11 to its exterior. Arm 36 is slidably received by first 38 and second 40 snap-in latch supports. First 38 and second 40 snap-in latch supports are spaced from one another along arm 36 and are attached to an interior wall of housing 11. Stopper 42 is attached to arm 36. Compression spring 44 on arm 36 is disposed between stopper 42 and second snap-in latch support 40. Arm 36 also has knob 46 disposed at its free end to make it more comfortable for the user to press the end of arm 36.

Figure 2D:
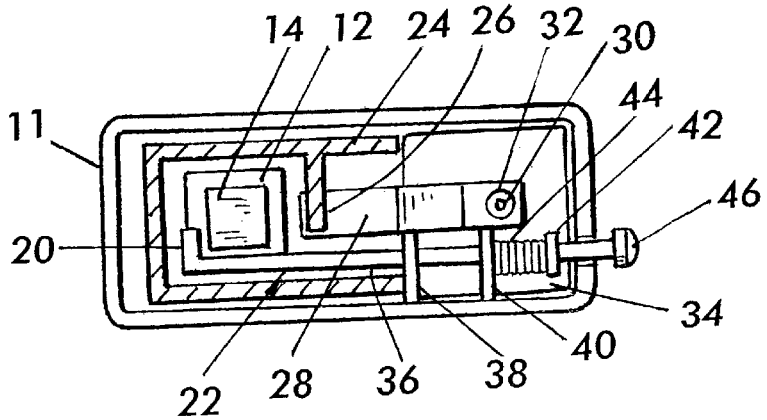
FIG. 2D is a cross-sectional view of the lighter shown in FIG. 2C along line 2D—2D in FIG. 2C looking in the direction of the arrows.

Now referring to FIGS. 2B and 2D, in its natural, expanded state, spring 44 presses against second snap-in latch support 40 and stopper 42, thereby keeping the two spaced at a predetermined distance set by abutment of stopper 42 with the interior housing 11. As a result, stop portion 20 is moved into notch 18 where transverse open surface 18*a* (FIG. 1A) is opposed by stop portion 20 to prevent the inward movement of plunger 14 into the interior of main casting 12. To release plunger 14, a user applies force to knob 46 at the end of arm 36. This force moves stop portion 20 out of the path of transverse open surface 18*a* (FIG. 1A) allowing plunger 14 to be pressed inwardly into main casting 12. Also, this force causes stopper 42 to be moved toward second snap-in latch support 40 causing spring 44 to be squeezed therebetween. When the force is removed from knob 46, spring 44 returns to its natural, extended state, thus forcing second snap-in latch support 40 and stopper 42 to be spaced apart. While second snap-in latch support 40 and stopper 42 are being spaced apart by the expansion of spring 44, plunger 14 is allowed to move outwardly outside of the interior of main casting 12 thus allowing stop portion 20 to be received in notch 18 (FIG. 1A) and to oppose transverse open surface 18A (FIG. 1A). Hence, the lighter according to the present invention cannot be operated unless plunger 14 is released by application of force to knob 46 at the end of arm 36. It is noteworthy that a lighter safety mechanism according to the present invention can be universally incorporated in any purpose lighter in that its operation does not depend on the configuration of the trigger or any other part of the lighter.

A movable latch of a particular configuration has been described. Any other element that may be an obstacle to motion of the plunger and that is movable between the stop and the open positions may be substituted.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A lighter comprising:

a housing;

a piezoelectric lighter ignition unit disposed within said housing, said piezoelectric unit including a main casting and a plunger with a plunger portion that is shaped and sized to be movable into said main casting, the plunger including a recessed surface oriented transversely to a direction of motion of said plunger into said casting; and a latch that is positioned to be selectively opposable by said recessed surface, to prevent said plunger portion from moving into said main casting when said latch is in a stopping or locked position, and said latch being movable to an open position to allow the movement of said plunger into said main casting.

2. A lighter according to claim 1, wherein said latch includes an arm that extends out of said housing such that said latch is operable to its positions by motion of the latch along the length of the arm.

3. A lighter according to claim 2, further comprising a knob disposed on an end of said arm for moving said arm.

4. A lighter according to claim 2, further comprising a latch support disposed in said housing and slidably receiving said arm as it moves.

5. A lighter according to claim 2, further comprising a stop in said housing, a stopper disposed on and movable with said arm, and a spring disposed between said stopper and said latch support and said spring normally urging said stopper to engage said stop in said housing; said stopper is so placed on said arm that with said stopper engaging said stop, said arm operates said latch to said stopping position, and said arm is movable to move said stop portion of said latch to said open position.

6. A lighter according to claim 5, further comprising a latch support disposed in said housing and slidably receiving said arm as said arm moves.

7. A lighter according to claim 2, wherein said stop portion of said latch forms an L shaped unitary latch together with said arm.

8. A lighter according to claim 7, wherein said stop portion and said arm are integrally connected.

9. A lighter according to claim 1, further comprising a notch in a side of said plunger, said recessed surface being part of said notch.

10. A lighter according to claim 1, further comprising an operable trigger operatively connected to said plunger for moving said plunger into said casting.

11. A lighter according to claim 8, further comprising a chamber for housing flammable fluid lighter fuel, a valve openable to allow fuel to exit said chamber.

12. A lighter according to claim 11, further comprising a lever operable for opening said valve, and a trigger including a portion that abuts said lever and operates said lever for opening said valve when said trigger is operated to move said plunger into said main casting.

13. A safety mechanism for selective prevention of the operation of a piezoelectric unit for a lighter, comprising:

a main casting; a piezoelectric lighter ignition unit having a plunger that is selectively moveable into said main casting to generate a spark for ignition of a flammable gas, said plunger having a stop element oriented transversely to the direction of motion of said plunger into said casting; and a latch having a stop portion, said latch being selectively moveable to a position where said stop portion may oppose said stop element to obstruct the movement of said plunger into said main casting.

14. The safety mechanism of claim 11, further comprising a housing in which said piezoelectric unit is disposed, and said latch includes an arm integrally connected to said stop portion and extending from inside to outside of said housing.

15. A safety mechanism for selective prevention of the operation of a piezoelectric unit for a lighter comprising:

a main casting;

a piezoelectric lighter ignition unit having a plunger that is selectively moveable into said main casting to generate a spark for ignition of a flammable gas, a movable stop located adjacent to the plunger and movable between a plunger stopping position in which the stop engages the plunger and an open, plunger moving position, in which the stop is away from and disengaged from the plunger, the stop being shaped and positioned for preventing the plunger from moving into the casting when the stop is in the stopping position and permitting the plunger to move into the casting with the stop in the open position.

16. In combination:

a lighter comprising a housing; and a safety mechanism according to claim 15 in the housing.

17. The combination of claim 16, further comprising a spring normally urging the stop to the plunger stopping position.

* * * * *